US006897367B2

(12) United States Patent
Leach

(10) Patent No.: US 6,897,367 B2
(45) Date of Patent: May 24, 2005

(54) METHOD AND SYSTEM FOR CREATING A MUSICAL COMPOSITION

(75) Inventor: Jeremy Louis Leach, Reading (GB)

(73) Assignee: SSEYO Limited, Berkshire (GB)

( * ) Notice: Subject to any disclaimer, the term of this patent is extended or adjusted under 35 U.S.C. 154(b) by 34 days.

(21) Appl. No.: 10/240,012

(22) PCT Filed: Mar. 27, 2001

(86) PCT No.: PCT/GB01/01365

§ 371 (c)(1),
(2), (4) Date: May 30, 2003

(87) PCT Pub. No.: WO01/73748

PCT Pub. Date: Oct. 4, 2001

(65) Prior Publication Data

US 2003/0183065 A1 Oct. 2, 2003

(30) Foreign Application Priority Data

Mar. 27, 2000 (GB) ..... 0007318

(51) Int. Cl.[7] ..... G10H 7/00; A63H 5/00; G04B 13/00

(52) U.S. Cl. ..... 84/609

(58) Field of Search ..... 84/609, 634

(56) References Cited

U.S. PATENT DOCUMENTS 4,982,643 A 1/1991 Minamitaka
5,418,323 A 5/1995 Kohonen
5,496,962 A 3/1996 Meier et al.
5,736,663 A 4/1998 Aoki et al.
5,753,843 A * 5/1998 Fay ..... 84/609
6,696,631 B2 * 2/2004 Smith et al. ..... 84/645

FOREIGN PATENT DOCUMENTS

WO WO 99 46758 A 9/1999

OTHER PUBLICATIONS

"Nature, Music, and Algorithmic Composition", Jeremy Leach and John Fitch, Computer Music Journal, 1995, 19:2, pp. 23–33.

Jeremy Leach, "Algorithmic Composition as Gene Expression Based Upon Fundamentals of Human Perception", Proceedings of the XI Colloquium on Musical Informatics—Bologna, Italy 1995 p7–10.

* cited by examiner

*Primary Examiner*—Jeffrey W Donels
(74) *Attorney, Agent, or Firm*—Morgan & Finnegan LLP

(57) ABSTRACT

A system for generating musical sounds uses rule-based algorithms to create rich and complex musical structures based upon a hierarchical framework or grid. Each rule, when triggered, automatically generates additional musical complexity based upon transitions between musical objects at a higher level in the hierarchy. The user can influence the music being generated by varying the number and configuration of the rules.

20 Claims, 9 Drawing Sheets

'*' in the structure is defined by rule: (4A+)(3A-)(1A+)(0A-)

*Figure 7*

(a) Start

NAME[Note]
LOCATION[All,(2A+)]
TERMINATES[All,(0A+)]

(b) After one operation

NAME[Motif]
LOCATION[All,(3A-)]
TERMINATES[All,"Note"]

NAME[Note]
LOCATION[All,(2A+)]
TERMINATES[All,(0A+)]

(c) After two operations

NAME[Motif]
LOCATION[All,(3A-)]
TERMINATES[All,"Note"]

NAME[Note]
LOCATION[All,(2A+)]
TERMINATES[End"Motif",(0A+),
Begin"Motif",(0A-)]

RULES

| | L | P | A | P | T | I | CONTEXT |
|---|---|---|---|---|---|---|---|
| RULE 1: | 6 | - | 10 | 0 | T | 0 | |
| RULE 2: | 5 | - | 0 | 1 | T | 0 | |
| RULE 3: | 4 | + | 2 | 1 | T | 0 | |
| RULE 4: | 4 | - | 0 | 0 | T | 0 | (6: 1 -10 -10) |
| RULE 5: | 4 | - | 0 | 2 | T | 0 | (5: -10 -10 3) |
| RULE 6: | 2 | N/A | 1 | 2 | T | 1 | (4,6: 1 -10 -10) |
| RULE 7: | 1 | + | 1 | 0 | T | 0 | (4: -10 3 1) |

FIG. 12

METHOD AND SYSTEM FOR CREATING A MUSICAL COMPOSITION

The present invention relates to a system usable for the composition of music, and/or for the generation of musical sounds.

Systems for composing music are known as such. In order to comply with conventions which have developed for recognisable music such systems are constrained by a number of internal rules in determining the nature of the physical sounds to be generated. Known such systems, often embodied in software or hardware, facilitate the composition of music by an operator by employing algorithms which work on the value of parameters set by the operator. Construction of a musical composition is then effected on the basis of a number of rules which are stored with the algorithms in a memory.

One of the disadvantages of known algorithmic music composition systems lies in the fact that they are relatively rigid and do not reliably and controllably generate musical structures which are readily recognisable as resembling Western music without the addition of specific rule sets constraining the operator assigned parameters within various limited ranges resulting in a certain "style" of music. Such inflexibility renders the use of such systems difficult, inefficient and for these reasons known such systems have not met with widespread success.

The generation of music requires a wide range of parameter variations to be available, not only in terms of the temporal occurrence of individual notes, but also their attack and decay, pitch (including pitch variations during the persistence of a note) timbre and other qualities affecting the perceived sound as well as the interconnections of notes which can be represented hierarchically as motif, phrase, theme, movement etc.

It is desirable, in order to produce a music generation system, to be able to take all of these features into account as well as providing for known musical properties such as rhythm, syncopation and hierarchical context sensitivity in which each musical unit or group such as a motif phrase or theme is expressed differently in terms of the properties listed above, when it occurs more than once in a piece, but in a different context. Without the ability to generate such variation music generation systems are mechanical and produce flat, uninteresting pieces.

The present invention seeks to provide apparatus for the generation of musical sounds, and a method of generating musical sounds in which a wide range of parameter variation is available both in terms of hierarchical context sensitivity and individual selection by the operator, as well as giving an opportunity to vary structural forms by the introduction of syncopation, rhythm changes and other such temporal variations which are found in traditionally composed musical structures. It is a particular feature of the present invention that the ability to manipulate syncopated structures emerges naturally from the ability to manipulate hierarchical context sensitivity with respect to temporal parameters.

According to one aspect of the present invention there is provided a method of creating a musical composition comprising:

(a) defining a multi-level hierarchical framework on which the composition will be based;

(b) defining a rule set comprising a plurality of rules for generating musical objects within the framework, each rule generating one or more musical objects at a given level within the framework in dependence upon one or more musical objects at a higher level within the framework.

In the preferred embodiment, each level within the framework defines a plurality of temporal regions divided by divisions, with each temporal region representing a multiple of contiguous temporal regions of a lower level (preferably the immediately lower level) in the structure.

Preferably, the musical objects are themselves defined by the respective temporal regions, each object existing just at a single level. Each musical object may be represented by a musical note having a defined start position, period and end position. The note or musical object may also be associated with an amplitude and with a pitch. Other attributes, such as timbre, can also be incorporated into the model, as could variable attributes such as gradually increasing or decreasing amplitude or pitch.

The invention further extends to a system for creating a musical composition, comprising:

(a) means for defining a multi-level hierarchical framework on which the composition will be based;

(b) means for defining a rule set comprising a plurality of rules for generating musical objects within the framework, each rule generating one or more musical objects at a given level within the structure in dependence upon transitions between musical objects at a higher level within the framework The framework preferably comprises a hierarchical network which may, but need not, be graphically represented by means of a grid.

The invention further extends to a computer program which embodies a method of creating a musical composition as previously described. It also extends to a computer-readable carrier which carries any such computer program.

According to yet another aspect of the present invention, there is provided a system for generating musical sounds on the basis of a hierarchical structure comprising a plurality of levels each related to at least one musical element, in which transitions between elementary components of each level are related to transitions between levels to determine the individual relationships between a plurality of individual sounds generated by the system.

In a preferred embodiment of the invention each of the hierarchical levels represent a multiple of the temporal divisions between successive transitions of a next higher level in the hierarchy.

Likewise, it is preferred that the temporal location of a parameter change is determined by sequential interactions between adjacent levels.

Of course, the commencement and termination of an individual musical sound may be determined by a pattern of transitions which result from the allocations of parameter values at successive levels by an operator. The temporal separation of transitions at each level in the hierarchy may be determined as an integral multiple of the number of transitions in the next adjacent higher level in the hierarchy.

There may further be provided means for interpolating the values of a parameter between beginning end values thereof at intervals determined by a selected level in the hierarchy.

Preferably, the individual relationships between a plurality of individual sounds generated by the system are over a parametric space including pitch, loudness and timbre.

In the preferred embodiment, the individual relationships between a plurality of individual sounds generated by the system vary in dependence or the context in which they occur.

Various features and aspects of the present invention will now be more particularly described, by way of example, with reference to the accompanying drawings, in which:

FIG. 1 illustrates in block diagram form the general structure of an embodiment of the invention;

FIGS. 2*a* and 2*b* illustrate diagrammatically the hierarchical structure of transitions on which the function of the system of the present invention is based;

FIG. 7 is a flow diagram illustrating some of the stages in the composition process;

FIG. 12 shows the rules used for FIG. 11; and

Figure 1:
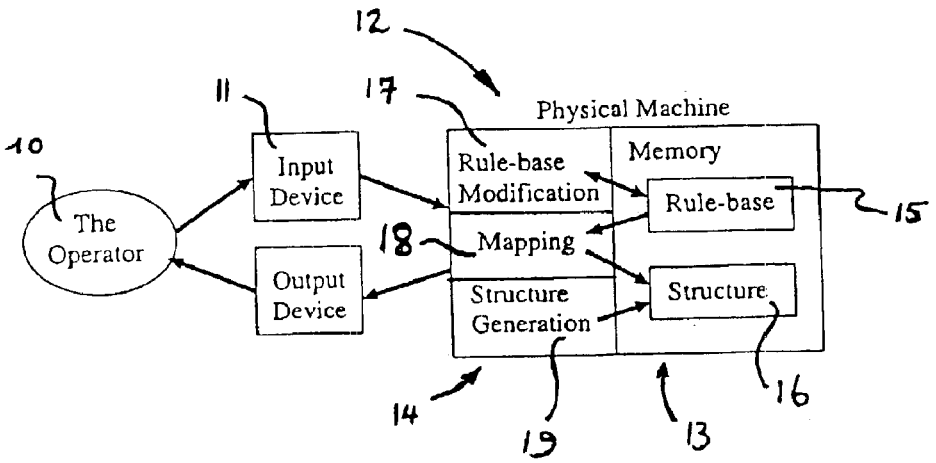

Referring first to FIG. 1, the system may be embodied in hardware or software (or even some other technological device) and comprises an input interface 11 by which an operator 10 is able to communicate with the physical machine generally indicated 12, which has two main components, namely a memory component 13 and an operating or processing component 14. The memory 13 has two sections, a first section 15 storing a set of rules and the other section 16 storing the transition structures defined by the operator and on the basis of which the musical sounds will be generated.

The processor section 14 includes a part 17 for modification of the rules, a mapping section 18, and a structure generation section 19.

Figure 2:
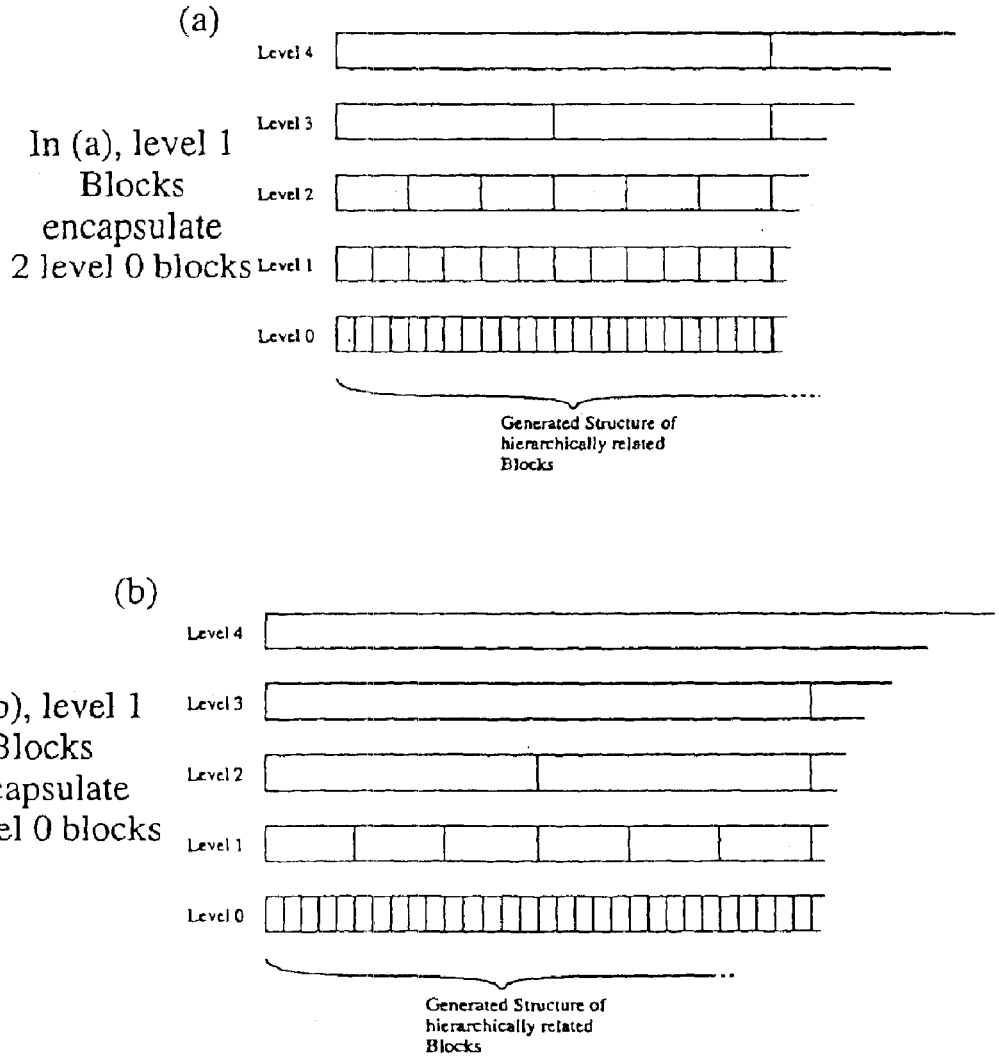

FIG. 2*a* illustrates one form of transition hierarchy illustrating five hierarchical levels numbered from level 0 to level 4, each containing transitions between adjacent temporal elements. Each temporal element may be considered to be one "block" of time, the diagrams representing time from left to right and, in accordance with the present invention, each adjacent hierarchical level representing the nominal separation of time into a number of blocks which is an integral multiple of the blocks of the next adjacent higher level. Thus, for example, in the embodiment of FIG. 2*a* the multiple for most of the level transition in the structure is two. This means that the block of time represented by one element (that is between adjacent transitions) in one level is represented by two blocks of time at the next lower level. As a variation, level 2 has a temporal division of three blocks, and therefore a multiple of three at level 2 rather than a multiple of two as in all other levels. In the embodiment of FIG. 2*b* there are successive variations in the multiple, with the multiples between levels 4 and 3 and between levels 3 and 2 both being two, the multiple between level 2 and level 1 being three and between level 1 and level 0 being five. In correspondence with conventional musical notation the time intervals represented by level 0 may be considered as the basic time signature for notes, whilst the time intervals represented at level 1 may be considered to correspond to "bars".

The hierarchies used in the present invention may be defined by "networks". Generally, a network may be defined by a series of integers which specify at each level, starting from level 0, how the blocks are to be combined. These "networks" act as definitions which can be schematically represented by grids, for example as shown in FIGS. 2*a* and 2*b*. The grid shown in FIG. 2*a* is defined by the network 2,2,3,2, while the grid of FIG. 2*b* is defined by the network 5,3,2,2.

Two separate embodiments will now be described, illustrating how these networks may be used within the preferred systems and methods for generating musical sounds according to the present invention. The underlying principles behind both of the embodiments are identical, but the detail and the nomenclature differ.

In both of the embodiments, the system parses and applies a sequence of rules in order to generate musical structure based on networks/grids of the type described above. The rules act upon musical objects or regions/transitions within the grid to create musical structures.

Typically, the network/grid will be predefined by the composer or user of the system, although it would also be possible for the system to generate its own network as required, either randomly or on the basis of some predefined constraints specified by the user. It would also be possible for the network definition to change dynamically at appropriate allowable points within the music. For the sake of simplicity, however, it will be assumed in the discussion below that the network and the grid are predefined and remain static during music generation.

First Embodiment

Figure 3:
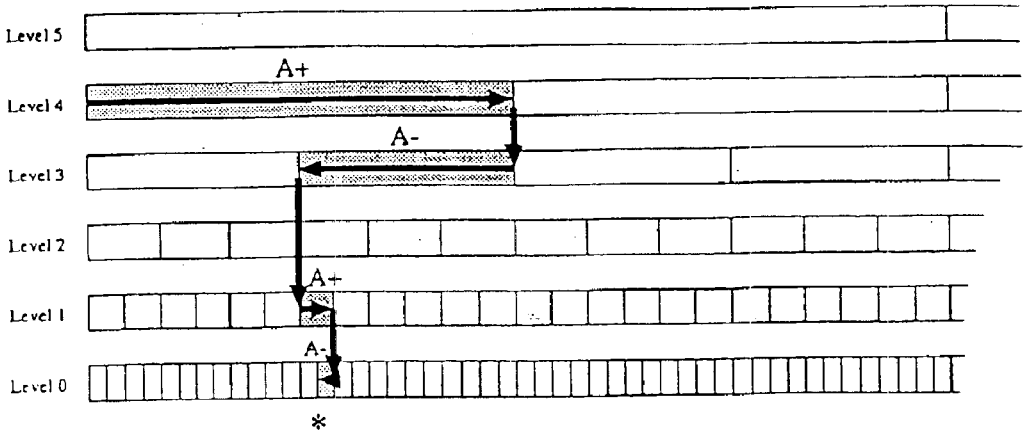
FIG. 3 is an exemplary representation of a pattern of transitions, according to a first embodiment, resulting in the determination of the temporal location of a specific musical element.

The manner in which the hierarchical transition structure is utilised by the physical machine in generating sounds will now be described in relation to FIG. 3. This represents a transition rule or statement which may be internally generated or determined by the operator. Transitions at each level will determine the nature of the musical composition at a successively higher level. For example, the position and length of the notes may be determined at levels 0, 1 and 2 the motif comprising a basic group of notes may be determined at level 3, a phrase, that is a set of motifs, may be determined at level 4, and a group of phrases may be determined at level 5. Thus, for example, a point in time represented by the asterisk at level 0 in FIG. 3 may be defined in the system by a statement in the form of a representation of directions from the origin. In the example of FIG. 3 the point in time is defined by a statement commencing at level 4 at the origin and utilising a nomenclature convention that A represents one temporal unit at that level. The statement or rule for identifying a transition at level 0 is:

$$(4A+)(3A-)(1A+)(0A-)$$

where the symbols + and − represent displacement in time from the relevant transition in a positive direction (+) or in a negative direction (−) which is represented in the diagram by displacement to the right (+) or displacement to the left (−) from the transition. Thus, the statement (4A+) is represented by the arrow at level 4 occupying the first time zone from the origin to the first transition at which a transition is made between levels to level 3. The statement (3A−) then represents a displacement to the left from the commencement point at that level, that is the transition at level 3 in temporal alignment with the terminating transition at level 4. Since each individual statement represents an integral number of temporal units of the next lower level each transition at one level will automatically correspond with a transition at the next lower level. In the statement illustrated in FIG. 3 there is no displacement at level 2, a (+) displacement (that is to the right) at level 1 and a displacement to the left (–) at level 0 to end at the transition identified by the * in FIG. 3. The transition statement thus defines a location in the hierarchical structure (and hence in time) measured from the beginning of the structure which constitutes the time origin.

The purpose of identifying this transition at level 0 by a structured statement as discussed above, rather than simply identifying it as the fourteenth transition at level 0, is because this manner of representation identifies a point in time after a given transition at a certain level, and this, thereafter, can be used to represent corresponding points in time bearing the same relationship to a repeated origin point. This statement, therefore, does not merely represent the single point in time represented by the asterisk in FIG. 3, but all points in a time stream which bear the same relationship to the transitions at level 4 as the asterisk-identified point bears to the origin at level 4.

The identification of individual temporal locations may be used to identify the beginning and end points of a musical element such as a note. In addition to these properties, a note requires the value of two other properties at least in order to be properly defined. These other properties are pitch and volume or loudness. These can be individually defined within fields in a memory which are linked by the relationships set out in the structure statement.

Figure 4:
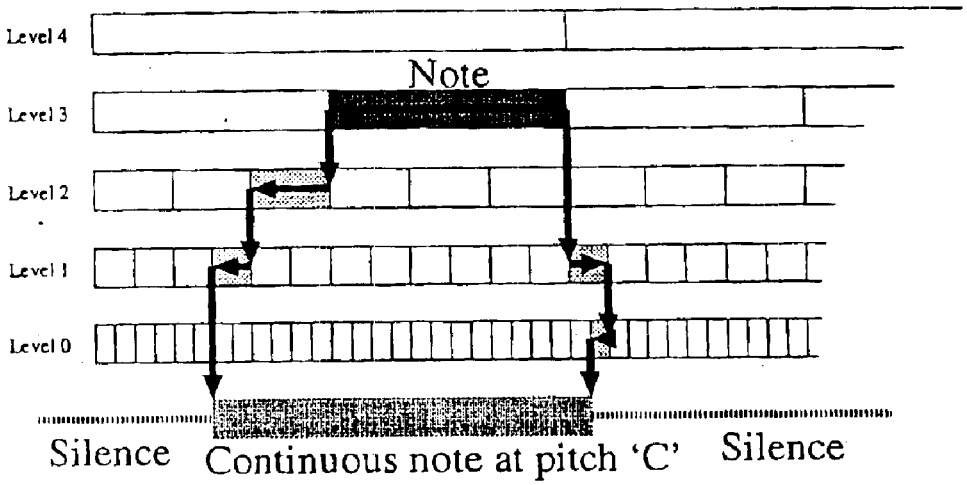
FIG. 4 is an alternative transition structure illustrating the manner in which the generation of a single note is effected.

FIG. 4 illustrates a structure for the generation of a single continuous note at a selected pitch. In general, the full identification of a note to be input by the operator 10 through the interface device 11 into the physical machine comprises a "name" for the musical element, which enables the machine to identify the level at which to commence the displacements in the structure statement. For example, if the "name" given in the structure statement is "note" the machine will, in this example, commence at level 3 with the first transition below level 4, which is the second transition at level 3. I should be understood, however, that the level at which to commence is determined by the level given in the description of the element, it is not predetermined. The representation of a note requires information defining the location, information determining the precise points in time for the commencement and termination of the note and an indication of the pitch and volume or loudness properties. This information can be represented in four fields which in this example entitled NAME, LOCATION, TERMINATES, PROPERTIES. Each field is specified by either a name or the combination of a context and a rule or a context and a property with an associated value. Thus, for example, in FIG. 4 the rule base for the musical object comprising a continuous note at pitch C may be represented as:

```
NAME[Note]
LOCATION [(3A-)]
TERMINATES  [Begin "Note" (2A–)(1A–)
            End "Note" (1A+)(0A–)]
PROPERTIES  [Pitch=C
            Loud=10]
```

In the above the conventional musical notation is used to identify pitch and the loudness is represented by a scale of arbitrary units. In this example the scale may run from 0 to 20 where 0 is silence and 20 is the maximum volume which can be generated by the equipment. Other, alternative scales are equally valid, however, and the above is presented purely by way of example. The basic location of the note is determined by the transition statement in the LOCATION field. This states that it is formed from a level 3 time block offset to the left from a higher level transition (in this case a transition from level 4) which identifies the first transition from the origin of level 3. The commencement of the note is defined by the statement in TERMINATES "begin note", namely (2A–) (1A–) which identifies the transition shifts of one unit to the left in level 2, one unit to the left in level 1 and no displacements at level 0. The "end note" statement (1A+) (0A–) identifies the transitions graphically represented in FIG. 4, namely no displacement at level 2, a displacement to the right at level 1 and a displacement to the left at level 0. The note identified by this statement illustrated in FIG. 4 is thus a continuous note at pitch C of loudness 10 commencing at the sixth timing unit at level 0 and terminating at the twenty-fifth transition.

In order to make the generated sounds context sensitive the TERMINATES field may include a statement specifying the context, on the basis of the position in relation to the next higher level in the hierarchy, although contexts in relation to hierarchical levels greater than the immediate level above that at which the statement applies may also be utilised. The context statements may be "all" (which means that the statement applies in all contexts), or "begin" (NAME), "end" (NAME) or a conjunction of several such terms. In this case the term "NAME" refers to the parameter identified at a specific level in the hierarchical structure.

Figure 5:
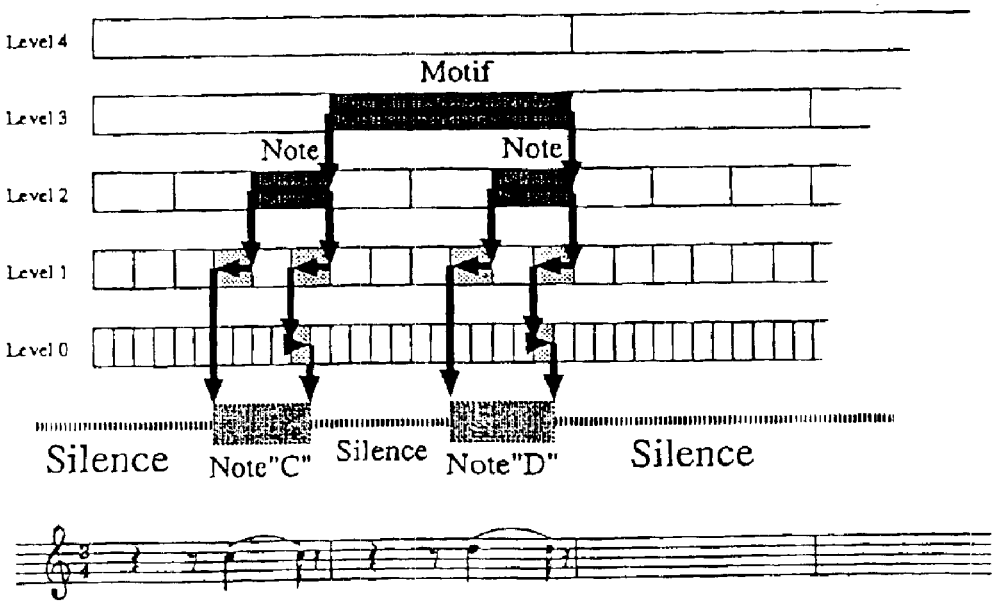
FIG. 5 illustrates a transition structure representing the generation of two notes, together with a musical notation in conventional form illustrating the notes generated thereby.

Referring now to FIG. 5 there is shown a graphical representation of a motif comprising two notes. The statement defining the motif is as follows:

```
NAME[Motif]
LOCATION [ALL,(3A–)]
TERMINATES[ALL,Note]
PROPERTIES[ ]
NAME[Note]
LOCATION[ALL,(2A–)]
TERMINATES  [Begin "Note", (1A–),
            End "Note", (1A–)(0A+)]
PROPERTIES  [Begin "Motif", Pitch=C,
            End "Motif", Pitch=D,
            All, Loud=10]
```

Here it will be seen that both the beginning and end of the musical element "Motif" are described by a single note (the context "All" in the TERMINATES field meaning both beginning and end in this case). In the definition of "Note" the PROPERTIES field defines the pitch of the note to be dependent on the context. Thus, when the note is at the beginning of the motif the pitch is set to C, whilst when the note is at the end of the motif the pitch is set to D. The statement shown here as an example results in two notes of equal length each occurring effectively at the end of a bar in what amounts to three/four time as a result of the time division of level 2 as three transitions for each single transition at level 3.

Figure 6:
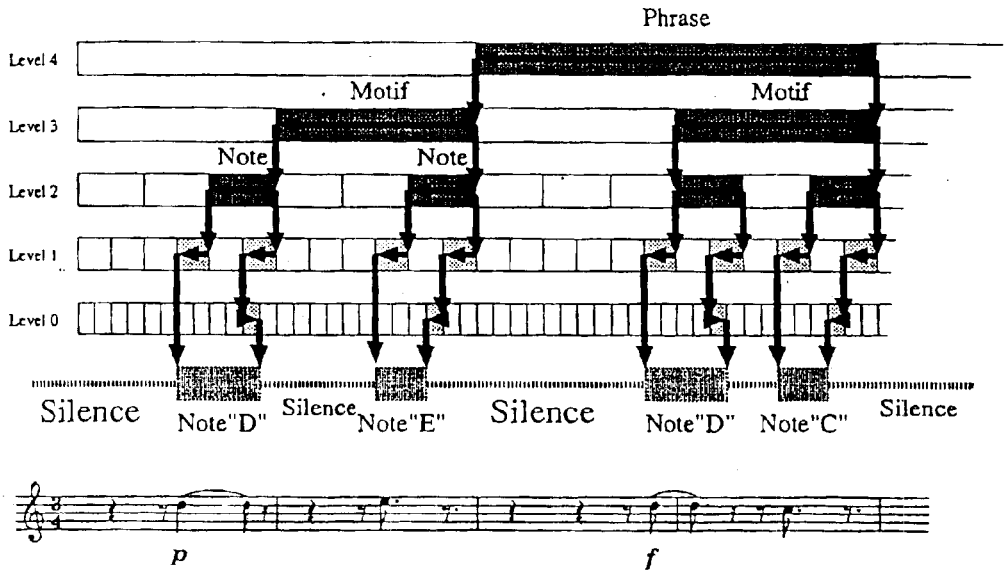
FIG. 6 illustrates a transition structure for generating a phrase comprising four notes, together with a conventional musical notation illustrating the notes thus generated.

FIG. 6 illustrates a structure represented by a phrase statement, that is a statement comprising two motifs each of two notes. Here the statement defining the phrase is as follows:

```
NAME[Phrase]
    LOCATION[ALL,(4A–)]
TERMINATES[ALL, "Motif"]
NAME[Motif]
```

-continued

```
LOCATION[ALL,(3A−)]
TERMINATES[ALL, "Note"]
NAME[Note]
LOCATION [Begin "Phrase", (2A−)
            End "Phrase"& Begin "Motif",
      (2A+),
      End "Phrase" & End "Motif", (2A−)]
   TERMINATES      [Begin "Note", (1A−),
                        Begin "Motif" & End "Note",
                        (1A−)(0A+),
                        End "Motif" & End "Note",
                        (1A−)(0A−)]
PROPERTIES      [Begin "Motif", Pitch=D,
                     Begin "Phrase" & End "Motif",
                     Pitch=E,
                     End "Phrase" & End "Motif",
                     Pitch=C,
                     Begin "Phrase", Loud=5,
                     End "Phrase", Loud=10]
```

Here it will be seen that the first motif represents the beginning of the phrase and the second motif represents the end of the phrase so that the first note of the second motif is by definition at the end of the phrase and therefore offset to the right of the level 3 transition and not to the left as with all the other notes. This is reflected in the transition statement under LOCATION at end "phrase" and Begin "Motif", (2A+) which identifies the note at the beginning of the motif at the end of the phrase. It will also be seen that the notes which are at the end of each Motif are shorter than those at the beginning of each Motif by the difference (0A+) and (0A−) although at level 1 the transition changes are all the same. This effectively makes the temporal position of the end of the notes vary in dependence upon whether the note is at the beginning or the end of the motif.

In order to create the rule statement on the basis of which the musical composition will be generated various different procedures may be adopted. FIG. 7 illustrates one procedure which commences with selection of the musical element "Note" which, as will be appreciated from a study of FIGS. 5 and 6, may be defined at a level determined by the higher levels at which other musical elements are determined. In FIG. 5 and FIG. 6 the note is defined at level 2 whereas in FIG. 4 "Note" is defined at level 3. The first operation, therefore, is to identify the name of the musical element to be selected (in this case "Note") and then the location and termination. Once these values are selected the note definition is "multiplied" which effectively means that the system moves up one level to what may be considered as a "parent" musical element, namely the "Motif". The values of the Motif may now be entered, as shown at step B. Of course, at this stage it is still possible to modify the transition statement relating to the "Note" and step C illustrates this situation where the operator has chosen to modify the "Note" element resulting in the offset of the beginning of the note now being different at the end of the motif from the beginning. The "Motif" element is then "multiplied" in the same way to shift up one level to the "phrase" level and the procedure is repeated.

Figure 8:
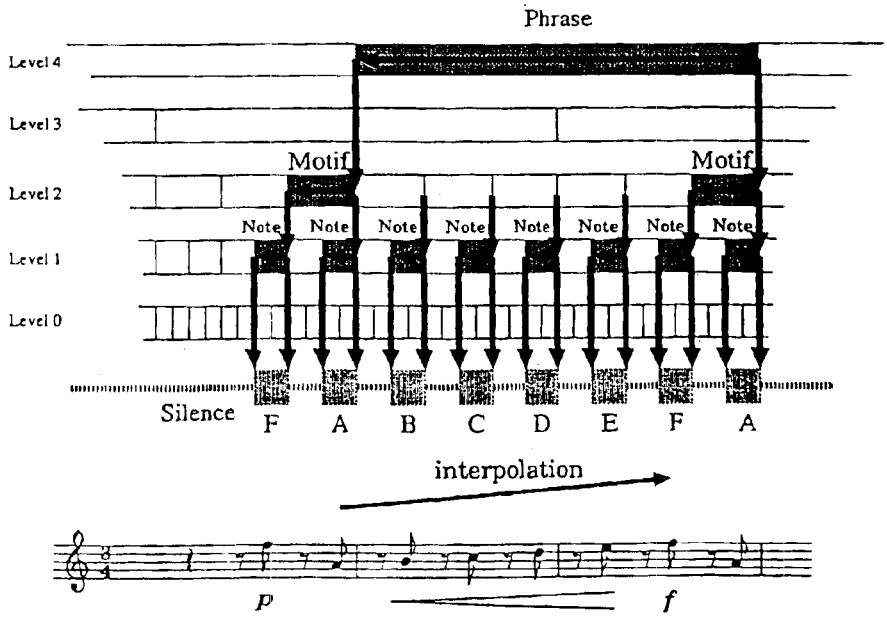
FIG. 8 illustrates a transition structure for a more complex phrase involving interpolation.

Of course, it is not necessary for the operator to specify every individual note in a phrase because, conventionally, Western music may at times be predictable in the variation of notes between two particular points, shifting in sequence by stepwise note changes in a pattern known as a scale. The available values of pitch in the PROPERTIES field are, in any event, limited to those having a predetermined scale relationship with one another and the system of the present invention offers the further sophistication that it can interpolate all relevant note pitch values between the beginning and end of a phrase simply by identifying the pitch value of the first note in the phrase and the last note in the phrase. FIG. 8 illustrates such a situation in which the transition statement reads as follows:

```
NAME[Phrase]
LOCATION[ALL, (4A−)]
MIDDLE[2, "Note"]
TERMINATES [ALL "Note"]
NAME[Motif]
LOCATION[ALL, (2A−)]
TERMINATES[ALL, "Note"]
NAME[Note]
LOCATION[ALL, (1A−)]
TERMINATES[ALL]
PROPERTIES      [Begin "Motif", Pitch=F,
                     End "Motif", Pitch=A,
                     Begin "Phrase", Loud=5,
                     End "Phrase", Loud=10]
```

Interpolation is achieved by the addition of another field, MIDDLE at the level of the "Phrase" element. The first value is 2 (comprising an index of the appropriate level) and the second value is the name of another musical element. In effect this field instructs the system during the mapping process to fill the empty space in the phrase with notes placed at the transition between every pair of level 2 time segments. In this case the properties of the additional musical element are interpolated from the values of the immediately preceding and succeeding elements at this level. In this case the pitch of the notes has been interpolated between A and F and the loudness of the notes has been interpolated between 5 and 10.

Figure 9:
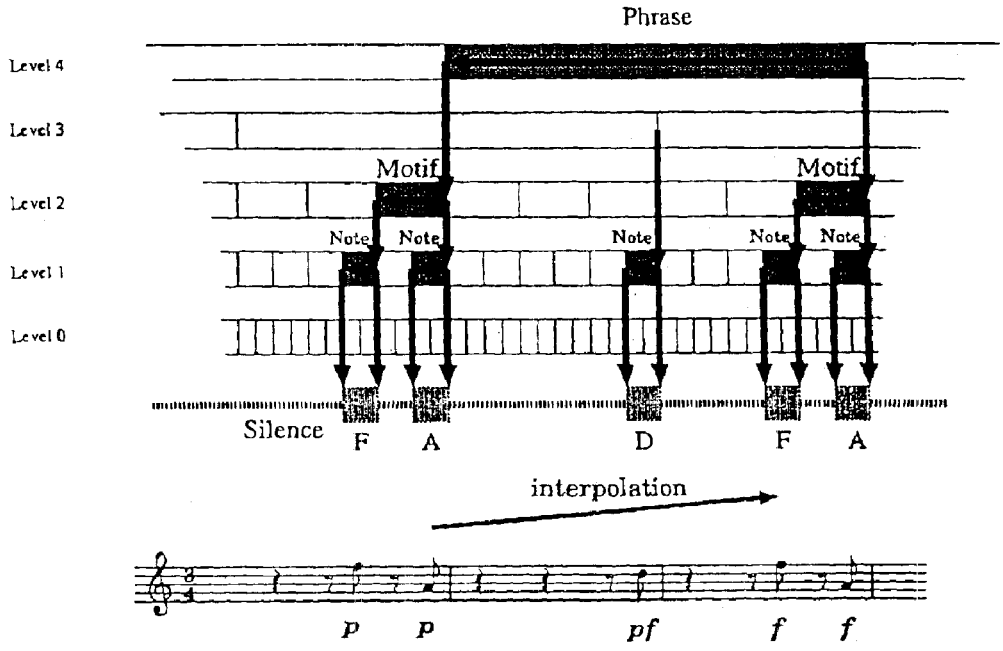
FIG. 9 illustrates an alternative transition structure involving interpolation.

FIG. 9 illustrates another example of interpolation, in which the MIDDLE field has a first value 3 identifying that the interpolation takes place from level 3. Since there is only one transition at level 3 between the beginning and the end of the phrase, only one additional note is interpolated in this instance.

Figure 10:
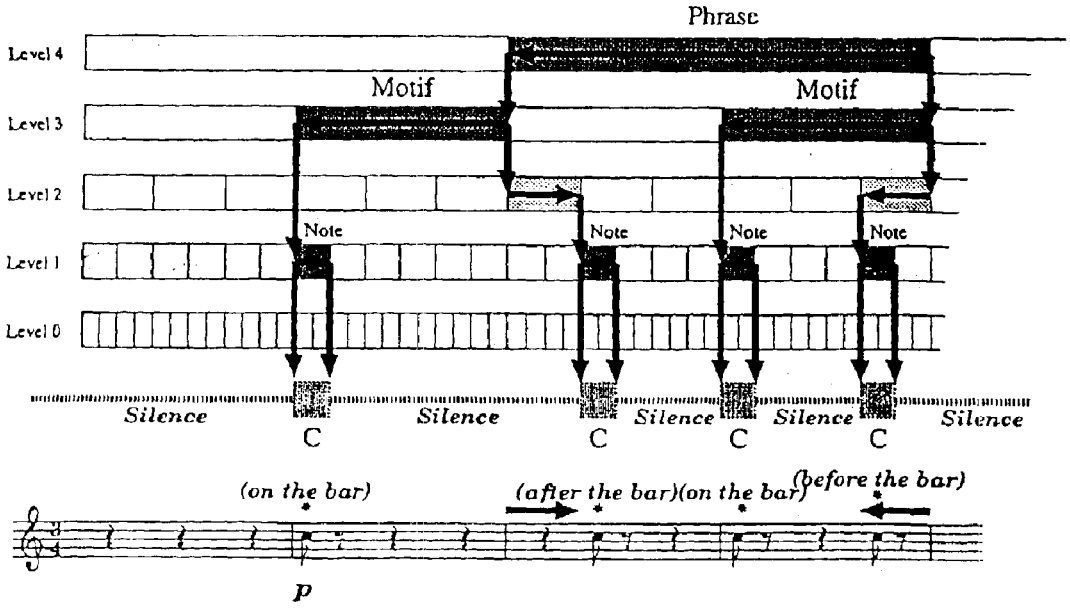
FIG. 10 illustrates a transition structure in which syncopation is achieved.

Finally, turning now to FIG. 10, an example of the statement values required to generate syncopation utilising this system is shown. In this case four notes are generated by the system with the first and third being located exactly at the beginning of each bar but the second and fourth being offset in delay and advance as will be described. The transition statement resulting in this is as follows:

```
NAME[Phrase]
LOCATION[ALL, (4A−)]
TERMINATES [ALL, "Motif"]
NAME[Motif]
LOCATION[ALL, (3A−)]
TERMINATES[ALL, "Note"]
NAME[Note]
LOCATION [Begin "Motif", (1A+),
            End "Motif" & Begin "Phrase",
            (2A+)(1A+),
            End "Motif" & End "Phrase",
            (2A−)(1A+)]
TERMINATES[ALL]
PROPERTIES[ALL, Pitch=C,
            ALL, Loud=5]
```

In this it will be seen that the second line in the LOCATION field states that the location of the note at the end of the motif but at the beginning of the phrase is delayed (offset to the right at level 2) whilst the third note is advanced i.e. offset to the left, as a result of the statement that the note at the end of the motif and at the end of the phrase is offset to the left at level 2. In this case the length of each note is determined at level 1 by the statement (1A+) at the end of each line in the LOCATION field, there being no level 0 transition statement.

Second Embodiment

The second preferred embodiment will now be described, with reference to FIGS. 11 and 12. As mentioned above, this embodiment uses the same underlying concepts as that of the first embodiment, but the detailed implementation and nomenclature differs.

The first stage in the procedure of this embodiment is to define the network and thus the grid on the basis of which the music will be generated. In this example, the grid used is that shown in FIG. 11, which may be defined by the integers 2, 2, 2, 2, 2, 2.

In order to generate music on the basis of the grid, the composer or user of the system defines a series of musical rules, some example of which are shown in FIG. 12. The collection of rules that are active at any one time is known is a "rule set". The completed grid, after application of the rule set, is referred to as the generated 'structure'.

Each rule is defined by a set of six primary parameters, namely level (L), position (P), amplitude (A), pitch (p), tonal information (T) and interpolation (I). Each rule may, but need not, also have an associated "context", to be discussed in more detail below. In order to illustrate how these various parameters are used in practice, we will now step through the process of generating music within the grid of FIG. 11 using the rule set illustrated in FIG. 12.

To start, the system automatically marks or "fills in" or "activates" the uppermost region of the grid 20. This uppermost region (at level 7 in this example) is referred to as the "universal region". For convenience, it is filled in automatically without any need for the user to write and implement a specific rule to that effect. The amplitude, pitch and tonal information associated with the universal region is likewise set by default: typically, the amplitude of that region is set to 0, so that the system starts with silence.

Figure 11:
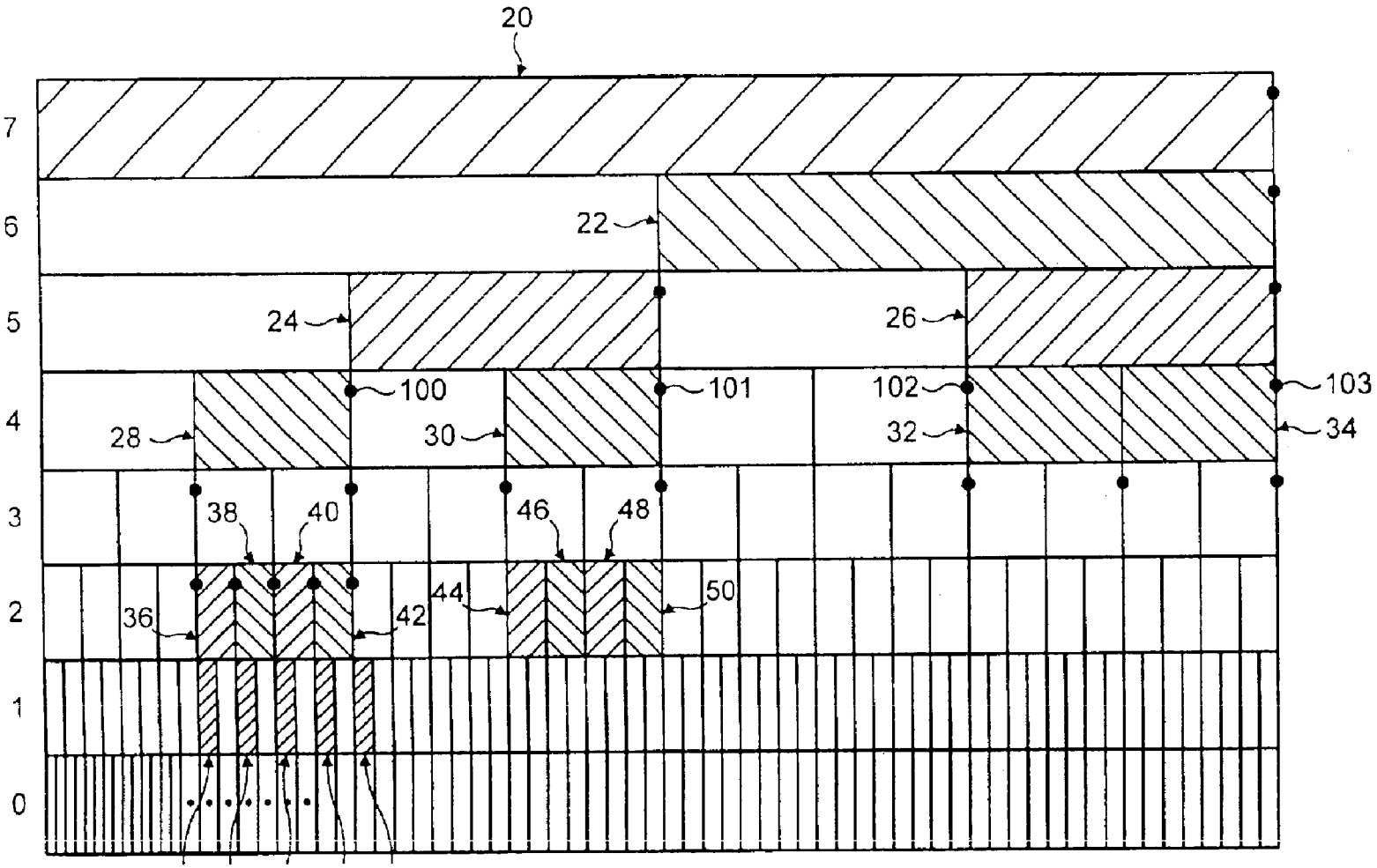
FIG. 11 shows a second embodiment, in operation.

In FIG. 11, activated areas are shown hatched, with transitions at each level being indicated by a black dot on the line representing the transition point. A "transition" at a particular level is said to exist where there is a change at that point in any higher level between an activated and a non-activated region. There is also deemed to be a transition where, at that point in any higher level, there is a conjunction of two activated areas.

It should be understood that there is deemed to be a transition at a particular level if there is a transition at the same point at any higher level. With the application of some rules there will not necessarily be a boundary between an activated and a non-activated area in the next level immediately above the current level, but there will always be such a boundary at that point in at least one of the higher levels.

Having completed level 7, the system now moves down to level 6, and it parses the rule set to determine which of the current rules are operational at that level. In the current example, only rule 1 is operational at level 6, and that rule is therefore parsed and applied.

In order to apply the rule, the system first looks for all transitions at the next highest level up (in this case, level 7). Here, there is only a single transition, at the end of the universal region 20 (or equivalently, at the beginning of the universal region, since it is of course to be understood that the grid "wraps", so that the left hand boundary is equivalent to the right hand boundary).

The position parameter of rule 1 is "–", which indicates that the block immediately before the transition is to be filled in. This results in the block 22 at level 6 being completed. The amplitude is 10, thereby indicating that the block 22 is to be given an amplitude which is ten steps up some predefined amplitude scale above that of its parent block 20. Since the amplitude of the parent block was 0, the amplitude associated with the block 22 is 10. The pitch offset is 0, so the block 22 is assigned the same pitch as the block 20. The tonal information for the block 22 is given by T, and the interpolation is 0: both of these parameters will be described in more detail below.

Once level 6 has been completed, the system moves to level 5, and looks for rules which are applicable at that level. In the present example, only rule 2 is applicable at level 5. Next, the system looks for transitions at level 6: in this example there are two, at the start and at the end of the block 22. Applying rule 2, two blocks 24,26 are filled in at level 5, each immediately preceding the two transitions as is indicated in rule 2 by the position parameter "–". Both blocks inherit all of their attributes from the parent block 22, except as otherwise specified in the rule which creates them. Rule 2 specifies that both of the blocks 24,26 have an amplitude offset of 0 (so they take the same amplitude as the parent block 22), and a pitch offset of 1 (so their pitch is one higher, according to some predefined scale, than the pitch of the block 22).

Next, the system moves to level 4, and identifies which of the rules within the rule set are applicable at that level. In the present example there are three such rules, namely rules 3, 4 and 5. Since only a single rule is allowed to trigger at each transition point, the system needs some mechanism for determining which of the rules will take precedence. That is dealt with by means of the "context" information which may optionally be associated with individual rules. The context information tells the system when the rule is to be applied, and the weighting to be given to it. If there is no context (as is the case with rule 3) the rule is deemed to apply to any transition between regions at a higher level. Thus, rule 3 applies to all higher-level transitions unless either rule 4 or rule 5 takes precedence.

The context information associated with the rule, where it exists, consists of a level number followed by three weighting values which relate, respectively, to Beginning, Middle and End. So, for example, in rule 4, the context information relates to level 6, and has Beginning, Middle and End weightings of respectively 1, −10 and −10.

At level 4, the system starts by determining all the transitions (four in this example), and then proceeds to apply each of the level 4 rules at each transition. The weighting of each rule, at each transition, is determined as explained below, and the rule with the highest weighting is considered to take precedence for that particular transition.

Where a rule has an associated context, the possible weightings for Beginning, Middle and End are given by that context. For a particular transition at level 4, the Beginning weighting is applied if that transition derives from the beginning of a block at the level specified within the context. So, for example, in rule 4, a weighting of 1 is given when the level 4 transition derives and is inherited from the beginning of a block at level 6. Likewise, a weighting of −10 is applied if the transition is inherited from the middle of a block at level 6, and a weighting of −10 is also applied if the transition is inherited from the end of a block at level 6.

The context of rule 5 means that a weighting of −10 is given to a transition at level 4 which is inherited from the beginning of a block at level 5; the same weighting is given if the transition is inherited from the middle of a block in level 5; and a weighting of 3 is given if the transition is inherited from the end of a block in level 5.

Where there is no context (as in rule 3), the rule is applied to all transitions at that level and is given a nominal weighting of 0.

The first of the transitions at level 4 is indicated by the reference numeral 100. Applying each of rules 3, 4, 5 at this transition, one finds that the rule 3 weighting is 0, the rule 4 weighting is 1 (since this transition derives from the beginning of a block at level 6), and the level 5 weighting is −10 (as the transition derives from the beginning of a block at level 5). The highest of these weightings is 1 and hence rule 4 takes precedence. The block 28 can therefore be filled in, according to the parameters specified in that rule: specifically, the block comes immediately before the transition and has 0 amplitude and pitch offset from its parent block 24.

In this embodiment, a rule triggers only if its weighting is greater than −1. Any rule with a weighting of minus 1 or less will never trigger, even if the resultant weight is greater than any other possible rule weighting at that level.

Applying rules 3, 4 and 5 at the transition 101 results in respective weightings 0, 1 and 3. The highest value here is 3, and hence rule 5 takes precedence. The block 30 can then be filled in according to the parameters of that rule: before the transition, with the same amplitude as the parent block 24, but with a pitch of two steps higher than the pitch of the block 24.

Applying the three rules to the next transition 102, gives respective weighting values of 0, −10 and −10. Here, the transition 102 derives from the end of a block 22 at level 6, but from the beginning of a block 26 at level 5. The highest weighting is 0, and hence rule 3 takes precedence. Block 32 may thus be filled in: this has a positive offset from the transition, has an amplitude two steps up the scale from that of the block 26, and a pitch one step up the scale from the pitch of that parent block.

The final transition at level 4 is at 103. Applying the three rules here gives respective weightings of 0, −10 and 3. 3 is the highest, so rule 5 takes precedence. The block 34 is accordingly filled in according to the parameters specified in rule 5.

There are several possible approaches for dealing with the situation where two rules end up with the same weighting. One simple approach would be to select one of the possibilities at random. Another approach would be to make use of some tie-breaking rule, such as always to choose an Beginning weighting in preference to an End weighting and to select randomly only if there is still a tie. More complex tie-breaking rules could of course be devised, some of which may be more musically desirable than others.

In the preferred embodiment (although not shown in FIGS. 11 and 12), each individual rule may have associated with it a number of different contexts. Where a rule has more than one context, it is evaluated separately at each transition point for each possible context, and the resultant weighting is determined. The final weighting to be applied to that rule is then taken to be the sum of all the individual context-based weightings.

All of the rules 1 to 5 are known as "edge rules" (or "transition rules"), since they operate by inheritance either from the front edge or from the rear edge of a higher-level block. Rule 6 is a different type of rule known as a "middle rule".

Rule 6 is a middle rule which applies at level 2. There is no positional attribute for a middle rule, and the P-value is therefore shown as N/A. The interpolation or I-value of this particular middle rule is 1.

If there is no context to a middle rule, it automatically fills in all available blocks at that level. The amount of filling in may be restricted by context, and in the example of rule 6, the context indicates that the rule is to fill in every block under a filled in level 4 region, where that level 4 region derives from a higher-level 6 region. If the inheritance is from the beginning of the level 6 region, the weighting is 1, and if from the middle or the end of the level 6 region the weighting is −10.

Since rule 6 applies at level 2, it operates to fill in the blocks at that level which are immediately beneath the blocks 28 and 30 of level 4. Both of these derive, ultimately, from a Beginning transition at level 6, and hence are given a weighting of 1. The rule does not fill in anything under the level 4 blocks 32,34 since both of those ultimately derive from an End transition at level 6, and hence receive a weighting of −10. As will be recalled, a rule triggers, in the present embodiment, only if the weighting is greater than −1.

If interpolate is set to be on (I=1) the rule disregards the amplitude and pitch that would otherwise be inherited from the parent, and instead interpolates both values, insofar as that is possible, from the start and end points of whatever is immediately above the fill. Floating-point calculations are not used: instead, the system simply makes musically-reasonable interpolations where possible. Accordingly, no interpolated pitch difference will be less than 1 semitone.

Finally, rule 7 is another transition rule, this time applicable at level 1. The context here specifies that the rule is to look at all transitions having a level 4 parent, and to trigger only if the transition arises from the middle or from the end of a level 4 region. For this purpose, all middle-fills are themselves taken to be "Middles": in other words, each of the regions 36 to 42 are deemed to derive from the middle of level 4 region 28, and each of the regions 44 to 50 are deemed to derive from the middle of the level 4 region 30.

Rule 7 results in the filling in of the areas 52, 54, 56, 58 and 60.

Each rule has associated with it tonal information, indicated in FIG. 12 by T. This specifies the scale information and provides a convenient way of limiting the notes that can be chosen by the system to a particular scale or scales. The approach used, described below, is a development of the approach described in *Leach, Jeremy and Fitch, John: Computer Music Journal*, 19:2, pp. 23–33, Summer 1995.

Figure 13:
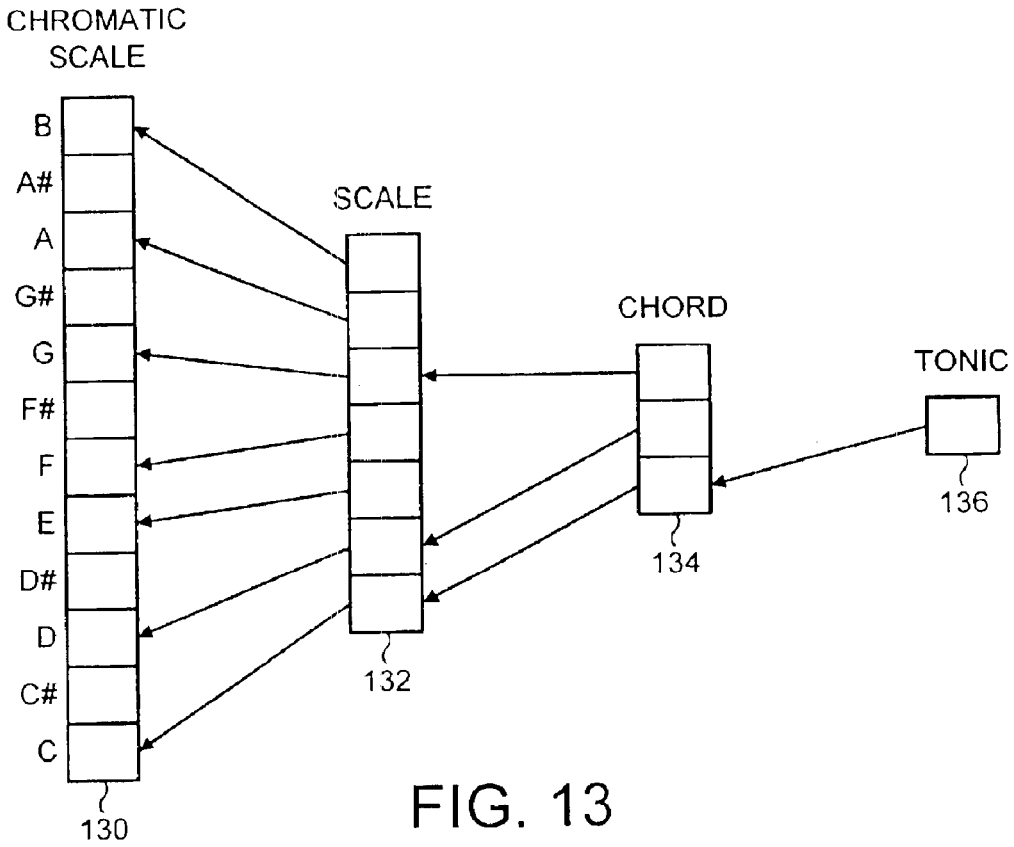
FIG. 13 shows the method of incorporating tonal information.

Tonal information for a piece of music may be represented as shown in FIG. 13 by means of a hierarchy of scales and sub-scales, each sub-scale being a sub-set of a higher-level scale. At the highest level is the chromatic scale 130, from which a specific scale 132 may be chosen. From that scale, a chord 134 may be chosen, and from the chord a single tonic note 136.

In the example shown, there are of course three possible positions for the tonic within the chord. Likewise, there are seven possible chord mappings to the scale 132 which will preserve the chosen chord intervals. Finally, there are twelve possible scale mappings onto the chromatic scale 130 in which the scale intervals are preserved. It may be helpful to visualise the chromatic scale, the scale and the chord as each being rotational. In order to supply a mapping structure for a piece of music, one simply needs to specify, by means of a vector, the rotational positions of each of the mappings. So, for example, the mapping position shown in FIG. 13 might be uniquely determined by the vector (6, 4, 1).

In the preferred embodiment, the tonal information T within each rule is represented by means of the vector followed by a single integer, for example (6, 4, 1):2. The final integer (2 in this example) tells the system how much of the vector is to be used to constrain possible note values.

A value of 2 means that the 6 and the 4 are used only, thereby constraining the system to the three possible notes available within the chord 134. A T value of (6, 4, 1):1 would allow the system to use any of the notes within the scale 132.

The system uses the tonal information first by checking the absolute pitch that it has inherited from above (for example C#). The nearest allowable option to that is then determined—in the case of (6, 4, 1):2, the system chooses whichever note within the chord 134 is closest to C#. Then, the pitch offset (p) is applied. If the pitch offset is, for example, 2, the system then counts up two steps within the three allowable notes of the chord 134, and works out the absolute value of the resultant note. The absolute pitch of that note is then taken to be the pitch of the block that is to be filled in by that particular rule.

By encoding tonal information in this way, the system designer can vary the tonality of the piece of music being generated while remaining within an overall musical structure which ensures that only musically-acceptable notes may be created.

Once all of the rules within the rule set have been parsed, and the grid filled in, the system will then immediately or on request play the resultant music. This is achieved by starting at the left hand end of the grid and gradually moving across to the right. A single note is generated for each filled in region, the length of that note corresponding to the length of the region, and the amplitude and pitch of the note corresponding to the values that have been set by the underlying rules. Only a single note is played at once, that being determined at any point by the lowest-level filled in block. If several blocks are filled in at any one point (for example the blocks 52, 36 and 28), then only the lowest-lying block 52 will sound. At the end of the note represented by the block 52, there is no block filled in at level 1, and hence the block 36 in level 2 will sound. This continues until the end of the grid is reached.

Alternatives

The following alternatives are possible, although they are not at present incorporated into the preferred system.

Instead of keeping all of the links from one level back to its ancestor levels, one could instead simply base a rule on what is immediately to the left and immediately to the right of a transition at the next level up. With such an approach, the rule contexts would depend upon the immediate area of the transition being looked at, rather than upon its higher-level ancestry.

To provide for additional flexibility, each rule could, in addition, include an "adopt" parameter. That would force the rule to inherit not from its parent block but instead from the block immediately above the block which is currently being filled in. So, for example, turning back to FIG. 11, rules could be devised which would allow the block 60 at level 1 to "adopt" characteristics of the level 5 block 24, rather than from its level 2 parent 42. Options for "adopt" include:

1. Inherit from whatever is directly above;
2. Inherit from whatever is not directly above;
3. Inherit from parent, and
4. Inherit from whatever is not the parent.

For option 2 and 4, above, the system would move either to the left or to the right of the relevant block to avoid either what is immediately above or the parent, respectively.

The level (L) values shown in FIG. 12 are specific integers, but it would also be possible, as with the first embodiment, to use names or logical values rather than fixed integers. That would enable a named rule to be used at a variety of different levels within the structure, depending upon context.

Rather than allowing only a single rule to operate at each transition, it would be possible to allow more than one rule to operate. For example, if one rule generates a block which moves forward of a transition and another rule a block which moves backwards of the same transition, both could be allowed to operate without interference.

In the preferred embodiment, the system is provided with an easy to use front end allowing a user or composer an easy mechanism for creating and modifying rule sets. The rules may be explicitly identified as such to the user, or alternatively, in a simplified product the rules may be hidden from the user and individual rule parameters may be fixed or may be modifiable only in combination. The system may allow the user to build the rules from the bottom up (for example by means of rule combining buttons) or alternatively from the top down (for example by means of rule-splitting buttons). Several systems could be run in parallel, to generate a plurality of individual voices. To ensure harmony, each of the voices may be based on the same underlying tonal structure, as for example shown in FIG. 13.

What is claimed is:

1. A method of creating a musical composition comprising:

(a) defining a multi-level hierarchical framework on which the composition will be based;

(b) defining a rule set comprising a plurality of rules for generating musical objects within the framework, each rule generating one or more musical objects at a given level within the framework in dependence upon transitions between musical objects at a higher level within the framework.

2. A method as claimed in claim 1 in which each level of the framework defines a plurality of temporal regions divided by divisions, each temporal region representing a multiple of contiguous temporal regions of a lower level in the framework.

3. A method as claimed in claim 2 in which the musical objects are defined by the respective temporal regions, each object having temporal start and end points corresponding with first and second divisions bounding the respective region.

4. A method as claimed in claim 3 including a rule which temporally positions a musical object in dependence upon a start point or an end point of an object at a higher level within the framework.

5. A method as claimed in claim 4 in which the said musical object is offset from the said start or end point of the object at a higher level within the framework.

6. A method as claimed in claim 1 in which the generated musical object inherits one or more properties from a parent object at a higher level within the framework.

7. A method as claimed in claim 6 in which the rule modifies the inherited properties of the parent object.

8. A method as claimed in claim 6 in which the inherited property comprises amplitude, pitch, tonal information or temporal position.

9. A method as claimed in claim 1 in which the composition is created by applying the rules within the rule set.

10. A method as claimed in claim 9, in which the transitions correspond, at a higher level in the framework, to a start or an end point of a musical object.

11. A method as claimed in claim 1 in which, for a given temporal position within a given level, all the rules operational at that level are evaluated.

12. A method as claimed in claim 11 in which each evaluated rule has a weight associated with it, the rule which is to be used to generate a musical object at the said level and temporal position being determined according to the respective rule weights.

13. A method as claimed in claim 1 including a rule to interpolate a property from starting and ending values applicable to objects higher in the framework, and to create interpolated musical objects based on corresponding interpolated values.

14. A method as claimed in claim 1 in which a pitch value for the generated musical object is selected from available pitch values which together define a tonal setting for the composition.

15. A method as claimed in claim 1 in which the generated musical object inherits one or more properties from a musical object higher in the framework which is at the same temporal location as the generated musical object.

16. A method as claimed in claim 1, including generating musical sounds from the created composition.

17. A method as claimed in claim 16 in which the musical sounds are derived, for each temporal position, from characteristics of a lowest-level musical object which exists at that temporal position.

18. A system for creating a musical composition, comprising:

(a) means for defining a multi-level hierarchical framework on which the composition will be based;

(b) means for defining a rule set comprising a plurality of rules for generating musical objects within the framework, each rule generating one or more musical objects at a given level within the framework in dependence upon transitions between musical objects at a higher level within the framework.

19. A computer program representative of a method of creating a musical composition as claimed in claim 1.

20. A computer-readable carrier carrying a computer program as claimed in claim 19.

* * * * *

UNITED STATES PATENT AND TRADEMARK OFFICE

CERTIFICATE OF CORRECTION

PATENT NO. : 6,897,367 B2
DATED : May 24, 2005
INVENTOR(S) : Jeremy Louis Leach

It is certified that error appears in the above-identified patent and that said Letters Patent is hereby corrected as shown below:

Title page,
Item [56], References Cited, OTHER PUBLICATIONS, insert -- Curtis Roads, "The Computer Music Tutorial", Chapters 18, 19, 1996 MIT Press --.

Signed and Sealed this

Second Day of August, 2005

JON W. DUDAS
*Director of the United States Patent and Trademark Office*